United States Patent [19]

Petrie

[11] 4,007,538

[45] Feb. 15, 1977

[54] METHOD OF CONSTRUCTING A STRUCTURAL MEMBER

[76] Inventor: John David Petrie, 1112 ManuLife House, 603-7th Ave., S.W., Calgary, Alberta, Canada

[22] Filed: Sept. 18, 1975

[21] Appl. No.: 614,602

Related U.S. Application Data

[62] Division of Ser. No. 510,863, Sept. 30, 1974, Pat. No. 3,925,943.

[30] Foreign Application Priority Data

Oct. 2, 1973 Canada ..... 182482

[52] U.S. Cl. ..... 29/447; 264/145; 264/150; 264/209; 264/295

[51] Int. Cl.[2] ..... B23P 11/02

[58] Field of Search ..... 29/447, 525, 418; 52/108; 264/150, 173, 177 R, 209, 295, 145

[56] References Cited

UNITED STATES PATENTS

| | | | |
|---|---|---|---|
| 913,651 | 2/1909 | Shawell | 29/418 X |
| 1,955,728 | 4/1934 | Allen et al. | 29/447 UX |
| 2,202,875 | 6/1940 | Sperry | 264/295 |
| 2,998,985 | 9/1961 | Burns et al. | 264/295 X |
| 3,349,526 | 10/1967 | Schuster | 52/108 |
| 3,538,208 | 11/1970 | Ohtsuka | 264/150 X |
| 3,710,529 | 1/1973 | Pass | 52/108 X |
| 3,723,237 | 3/1973 | Fuss | 264/150 |
| 3,874,060 | 4/1975 | Barnes | 29/525 X |
| 3,949,530 | 4/1976 | Williams et al. | 264/145 X |

*Primary Examiner*—Charlie T. Moon

[57] ABSTRACT

A structural member capable of being coiled by bending the member in one direction and being uncoiled by bending it in the other direction to form a frame member which is relatively rigid. This member is constructed by forming an elongated one-piece body of suitably flexible material, such as polypropylene, by extrusion. Strong, flexible threads are embedded in one side of the body and a passageway is formed extending lengthwise through the body during the extrusion. The body member is then cut or notched transversely at locations distributed along the length of the body member. Each cut extends inwardly from the side of the body member oppisite said one side and has a bottom near but spaced apart from said one side. Sheer members of suitably strong material are inserted in one end of the passageway in end-to-end relationship until they extend substantially the length of the body member and are properly positioned. Each sheer member traverses one of the cuts when the structural member is uncoiled to absorb sheer forces at the cut.

12 Claims, 13 Drawing Figures

METHOD OF CONSTRUCTING A STRUCTURAL MEMBER

This is a division of application Ser. No. 510,863 filed Sept. 30, 1974, now U.S. Pat. No. 3,925,943.

BACKGROUND OF THE INVENTION

This invention relates to coilable structural members suitable for use as tent and other types of frame members and a method of construction thereof.

Frame members presently in use for the erection of tents and other temporary structures may or may not be collapsible. If they are not collapsible, they are often difficult to transport or to store away for future use. Often tent poles must be quite long in order to provide the necessary height to the roof of the tent. Similarly long horizontal or diagonal frame members may be necessary to erect a large or medium size tent. If the poles or frame members are constructed of wood or metal and are not collapsible, they may be quite heavy and unwieldly to transport. In addition wood is becoming increasingly more expensive and suitable lightweight metal such as aluminum or its alloys is already expensive.

If the tent pole or frame member is collapsible, it is usually collapsible at only one or two locations so that even when the pole or frame member is disassembled, relatively long and heavy segments are left which are still difficult to store or transport. In addition, it is possible for one segment to be misplaced rendering the remaining segments useless. Often the segments are fastened securely together by the use of some screws which are easy to lose.

Accordingly it is an object of the present invention to provide a structural member which overcomes many of the above problems associated with previous frame members and poles and a simple, inexpensive method for constructing this structural member.

It is a further object of the invention to provide a one-piece structural member which can be coiled into a compact body by bending it in one direction in order to store or transport it and when it is to be used as a frame member, the structural member can be uncoiled by bending it in the opposite direction until the frame member is formed. The resulting frame member is relatively rigid except of course when the member is bent in the one direction by which it is coiled. The present structural member need only be fastened in such a manner that it cannot bend in this direction.

The structural member of the present invention may be constructed of inexpensive and light weight plastic materials such as polypropylene and may be produced by mass production methods. No screws or other fastening means are required to connect parts of the frame member since the structural member consists of only one main piece.

It is another object of the invention to provide a novel simple, inexpensive method of constructing a structural member of the above-mentioned type.

SUMMARY OF THE INVENTION

Accordingly the structural member of the present invention comprises an elongated one-piece body member of suitably flexible material having a passageway extending lengthwise therethrough and transverse cuts or notches distributed along its length. These cuts or notches extend inwardly from one side of the body member and have a bottom near but spaced apart from the opposite side of the body member. The body member is thus divided into member segments by the cuts or notches with each member segment being joined to an adjacent member segment by a relatively thin, flexible joint. Sheer members of suitably strong material are fitted securely in the passageway, a first portion of one sheer member being disposed in each of the member segments and the remaining portion protruding from one end of the member segment in which the first portion is disposed. The remaining portion extends into the passageway of the adjacent segment when the structural member is uncoiled whereby each sheer member absorbs sheering forces at adjacent ends of adjacent member segments.

In a preferred embodiment of the present structural member, suitably high tensile strength flexible members, such as glass fibres or nylon thread, extend lengthwise along the body member between adjacent member segments and through each flexible joint.

The method of construction according to the present invention uses an extrusion process to mould or form the elongated one-piece body from suitable, flexible material such as polypropylene. The high tensile strength, flexible members are embedded in one side of the one-piece body during the extrusion process. Thus a separate step to fasten the flexible members to the body member and the need for fastening means such as clamps, bolts or glue are avoided. After the one-piece body is formed, the body is cut with the above mentioned series of cuts or notches.

Preferably during the extrusion process, at least one passageway is formed in the one-piece body running lengthwise therethrough. After this body is formed, and preferably after the body has been cut or notched as described, sheer members are inserted in the passageway and secured against movement in the passageway from their proper position.

Use of the present structural member is not limited to that of a tent frame or pole but extends to a wide variety of uses including the erection of temporary material storage shelters and construction and exploration personnel shelters. They can also be used as frames and parts in camping or outdoor equipment such as roll-up type camp or beach chairs, camp beds, sun cots, and collapsible or folding boats. Ladders and various orthopedic appliances may also be constructed, in part at least, from the structural members of the present invention.

BRIEF DESCRIPTION OF DRAWINGS

In drawings which illustrate preferred embodiments of the present invention.

DETAILED DESCRIPTION OF PREFERRED EMBODIMENT

Figure 1:
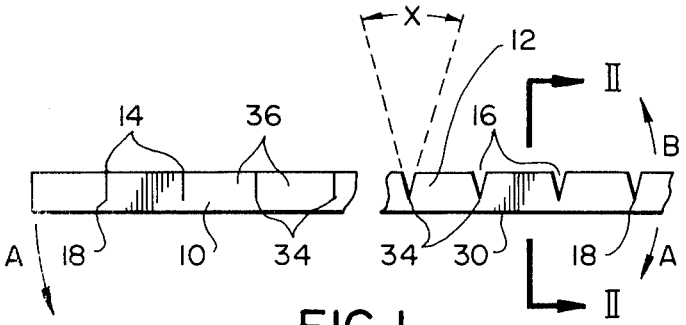
FIG. 1 is a partial side view of a structural member according to the present invention.

As shown in FIG. 1, the structural member 10, only the end portions of which are shown, comprises an elongated one-piece body member 12 in which cuts 14 or V-shaped notches 16 are cut or notched at locations distributed along the length of the structural member. In the embodiment of the structural member shown in FIG. 1, the left portion of a structural member is merely cut while the right portion of the member is notched. Each cut or notch extends from one side of the body member and has a bottom 18 near to but spaced apart from the opposite side of the member 12. The cuts or notches may be formed with a high speed knife which removes practically no material from the body member in making a cut.

Figure 2:
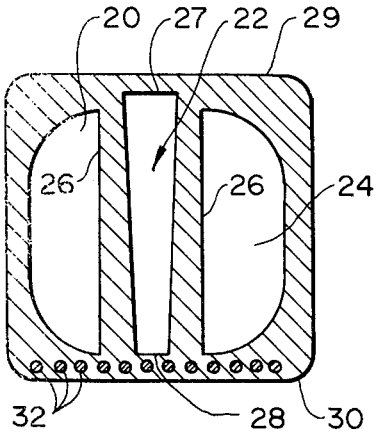
FIG. 2 is a sectional view taken along the line II—II of FIG. 1 showing the interior construction of the structural member.

The preferred internal structure of the member 10 is shown in FIG. 2 wherein the cross-section of three passageways 20, 22, and 24 is illustrated. These passageways extend the length of the body member 12 and, at least in the case of the two outer passageways 20 and 24, are intended to lighten the overall weight of the structural member so that it can be easily carried. The outer passageways have cross-sections which are the mirror image of each other and which generally correspond to a half-circle. Other shapes may of course be employed for the outer passageways but the half-circle shape is preferred as it gives the corners added strength to withstand corner stresses. The centre passageway 22 is divided from the outer passageway by two side walls 26 and is located in the horizontal centre of the body member as shown in FIG. 2. This centre passageway has a top 27 and a bottom 28, the top and bottom being located adjacent to but spaced apart from opposite sides 29 and 30 respectively of the body member. Preferably the inside surfaces of sidewalls 26 converge slightly towards each other from top 27 to bottom 28 for reasons discussed hereinafter.

Extending along the length of the body member 12 adjacent to the side 30, reinforcing members 32 are embedded in the body member. These members 32 consist of suitably high tensile strength, flexible cords or fibres such as glass fibers or nylon thread. The cuts 14 or notches 16 do not extend down to the members 32 but preferably terminate at their bottoms just short of these flexible cords or fibres.

The body member 12 must be constructed of suitably flexible material such as polypropylene which is preferred because it is relatively inexpensive, light, and capable of repetitive bending. Also, polypropylene will accept glass fibers or nylon thread in its interior and yet not lose is ability to be bent repeatedly. Thus when the cuts 14 or notches 16 are made in the body member, relatively thin flexible joints 34 are formed along the side 30 of the body member. Member segments 36 are also formed by the cuts and notches and these segments are linked together by the flexible joints 34. The flexible reinforcing members 32 extend at least from one member segment to the adjacent member segment through the intermediate joint 34 to give added tensile strength to the structural member. Preferably the reinforcing members 32 extend substantially the entire length of the structural member so that they can transmit tensile forces through the entire length of the member 10.

Figure 3:
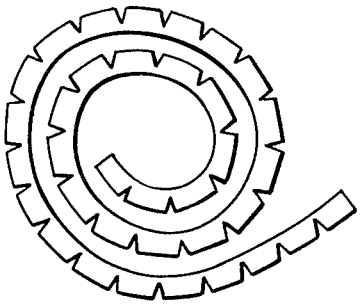
FIG. 3 is a side view of a structural member of the present invention coiled for storage or transport.

The structural member 10 of the present invention may be coiled in the manner shown in FIG. 3 by bending it in one direction, the direction shown by the arrows A of FIG. 1. In this coiled condition, the member 10 can be easily transported or stored away for future use. The cuts 14 or notches 16 must of course be deep enough and the joints 34 thin enough to permit this coiling to take place. The thinner the joints 34 are the better the roll-up qualities of the structural member.

Figure 4:
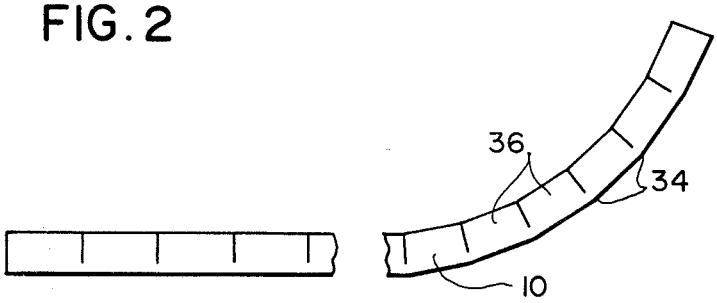
FIG. 4 is a view similar to FIG. 1 wherein the right end of the structural member is bent to form a curved frame member.

When the coiled structural member 10 is to be used again as a frame for a tent or whatever, the member may be uncoiled by bending it in the opposite direction to the direction in which it is bent to be coiled. If the cuts 14 have only been made in the structural member, the uncoiled structural member will be straight, assuming of course that the original "uncut" body member 12 was straight when it was formed. Thus the left portion of the structural member of FIG. 1 is straight. However, if notches 16 have been made in the structural member, as in the right portion of the member of FIG. 1, the structural member can be bent in the direction indicated by the arrow B of FIG. 1 to form a curved frame member as shown in FIG. 4. Each notch 16 is completely closed in this position so that adjacent ends of adjacent member segments abut each other. It can be readily seen by increasing the angle X formed by the sides of each V-shaped notch 16 there is an increase in the amount of curvature in the uncoiled structural member. Similarly by decreasing the angle X, one can decrease the curvature in the structural member. In order to form a smooth, circular arc, the notches should be spaced equal distances from adjacent notches and the angle X should be the same for each notch. Other types of curves may be formed either by varying the angle X from notch to notch or by varying the distance between adjacent notches. It is thus possible to design or form a structural member 10 which will take on a desired curve or combination of curves and straight lines when uncoiled.

Figure 5:
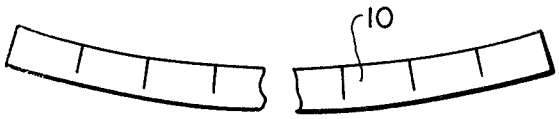
FIG. 5 is a partial side view of another embodiment of the present invention formed with a curve after extrusion and before notching.

FIG. 5 shows a structural member 10 which is curved slightly when formed and before the member is cut. Such a curved member need only be cut, as opposed to notched in order to form a coilable structural member which will form a predetermined curve when uncoiled. This is the preferred form of structural member for the tent frames for the tent described hereinafter. If the structural member is formed by extrusion as explained hereinafter, this predetermined curve can be imparted to the member during the cooling period after extrusion.

Preferably a sheer member 38 of suitably strong material is inserted in each member segment 36 (in the manner described hereinafter) either before or after the structural member has been notched or cut. The sheer members may be made of the same material as the body member 12, which is preferably made of polyproplylene, or some other material such as another type of plastic or aluminum. These members 38 may consist of fibre-filled or hardened polypropylene. The particular material used will depend to some extent on the particular use for which the structural member is intended and the loadbearing capacity required. The sheer members 38 may be made by means of a simple extrusion process wherein the members are extruded from a body of material and then cut to their proper longitudinal profile, or by any other of the known methods for forming articles of this type. One of the primary purposes of the sheer members 38 is to absorb much of the sheering forces exerted on the structural member at the joints between the member segments 36. The members 38 thus prevent the relatively thin, flexible joints 34 from being sheered off or torn, especially when the structural member is twisted. If the structural member is formed with a curve along its length then of course the sheer members will be formed with a corresponding curve in order to fit in the member segments.

Figure 6:
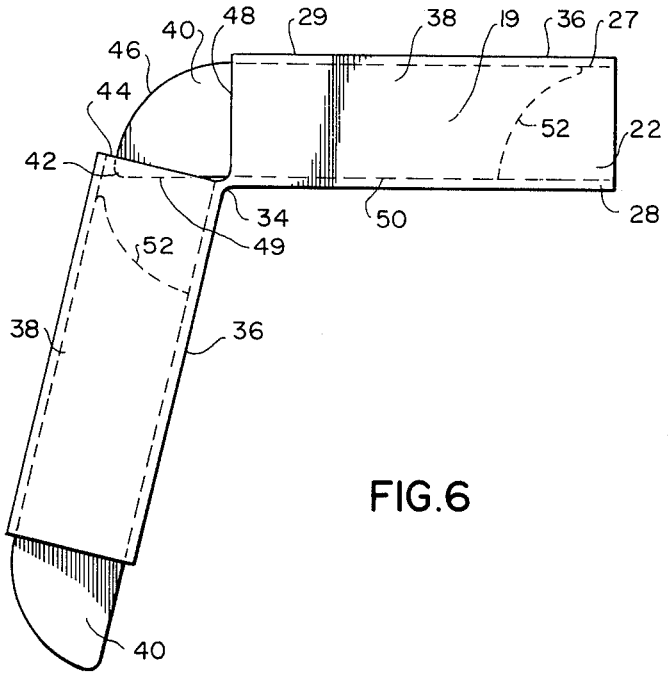
FIG. 6 is a side view of two segments of the structural member showing the manner in which each sheer member interlocks adjacent ends of adjacent member segments.
Figure 7:
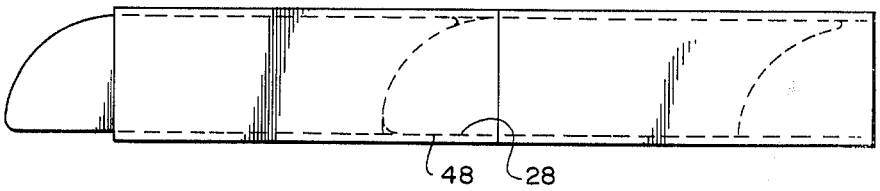
FIG. 7 is a side view similar to FIG. 5 in which the two member segments form a straight portion of a frame member.

The sheer members are inserted in the centre passageway 22 and fit snuggly therein, extending from the top 27 to the bottom 28 of the passageway and between the two sidewalls 26. Each sheer member has a first portion 19 disposed in a member segment and a remaining portion 40 which protrudes from one end of the member segment in which the first portion is disposed. This remaining portion fits snuggly into the centre passageway of the adjacent member segment when the structural member is uncoiled as can be seen from FIG. 7. If the sidewalls 26 of the centre passageway converge slightly in the manner shown in FIG. 2 and the adjacent sides of the sheer members converge in a similar manner, the uncoiling of the structural member is simplified. The relatively narrow bottom corner 42 of the remaining or end portion 40 fits easily into the top of the centre passageway of the adjacent member segment which is relatively wide (see FIG. 6) as the adjacent ends of the adjacent member segments are swung toward each other. Otherwise, if the sidewalls of the centre passageway are parallel to each other and the sides of the sheer members are also parallel to and immediately adjacent the sidewalls, the bottom corner 42 might catch on the end 44 of the adjacent member segment as the structural member is uncoiled. Each remaining or end portion 40 (hereinafter termed the "end portion") includes a sectorial part with a radius equal to the height of the passageway 22, that is, the perpendicular distance between the top 27 and the bottom 28. A cylindrical arc 46 of this sectorial part extends tangentially and downwardly from the plane of the top 27 and outwardly from the adjacent end 48 of the member segment. The centre axis of the sectorial part is located along the flexible joint 34 at the end 48. If the member segments are to combine to form a straight frame member or a straight portion of a frame member, then each end portion forms a quarter circle as shown in FIG. 6. In this case the bottom 49 of the end portion is parallel to and in the plane of the bottom 50 of the sheer member, the bottom 50 being adjacent the bottom 28 of the centre passageway. Thus when the two adjacent member segments are brought together in the manner shown in FIG. 7, the bottom 49 of the end portion is immediately adjacent the bottom 28 of the adjacent member segment.

If the member segments are to combine when uncoiled to form a curved frame member or a curved portion of a frame member as shown in FIG. 4, then the angle Y (see FIG. 9) of the sector formed by each end portion 40 must be such as to permit adjacent ends 44 of the member segments to be brought together while at the same time permitting the bottom 49 of the end portion to rest next to the bottom 28 of the centre passageway. If the angle of the notch formed between the adjacent member segments is X, as shown in FIG. 1, then the angle through which one member segment is pivoted with respect to the adjacent member segment is X. It will be understood from FIG. 9 that the angle Y must equal 90° minus X. The bottom 49 of the end portion forms an angle X with the plane of the bottom 50 of the sheer member. Preferably the end 52 of each sheer member, which is the end opposite the end portion 40, is stamped or formed in the shape of a cylindrical arc which co-operates with and slidingly engages the cylindrical arc 46 of the end portion 40 of the sheer member in the adjacent member segment. This engagement of the end 52 of one sheer member with the adjacent end portion 40 of an adjacent sheer member gives the structural member additional strength to withstand compression loads along the length of the structural member when it is uncoiled.

Figure 8:
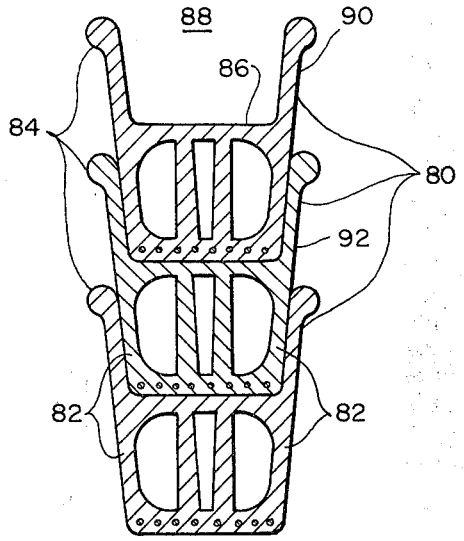
FIG. 8 is a partial cross-sectional view of another embodiment which has been coiled, half the cross-section of the coil being shown.

FIG. 8 illustrates the cross section of another embodiment of the structural member 10. This member has walls 80 projecting upwardly from each sidewall 82 of the structural member. The walls 80 extend the length of the member and may be formed with enlarged ends 84 to give the top of each wall 80 increased rigidity and increased cross-section in order to withstand the compression forces in this area of the member 10. The walls 80 and the reinforcing wall 86 thus form a U-shaped trough 88 in the top of the structural member. When the member 10 is coiled for transport or storage, the bottom portion of a single coil 90 fits snuggly in the U-shaped trough 92 of the single coil 90 immediately adjacent and within the coil 90 as shown in FIG. 8. This interlocking feature of the coils is advantageous as it prevents the coils from being displaced axially with respect to each other and avoids the need for a special container.

It will be understood that the bottom portion (i.e., the portion excluding walls 80) of the structural member of FIG. 8 can be constructed similarly to the structural member shown in FIGS. 1 and 2 including the use of flexible members 32 and sheer members. It will also be understood that FIG. 8 shows the cross-section of only one-half of the coil.

Figure 10:
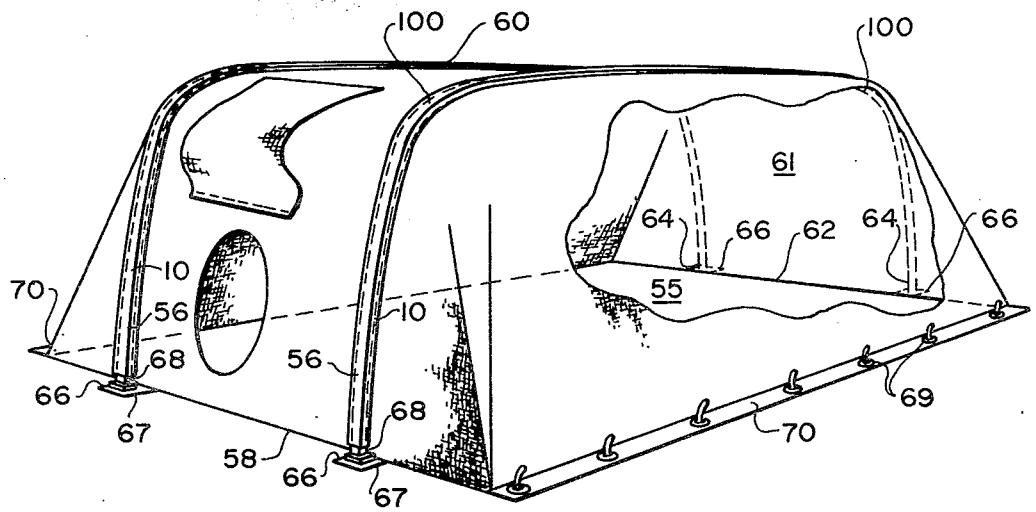
FIG. 10 is a perspective view of a tent in which two structural members of the present invention are employed.

FIG. 10 illustrates the use of two of the structural member 10 as frames for a tent 54 having two passageways formed by the sleeves 56 extending from one end 58 of the floor 55 of the tent, up one side 59 of the tent across the top 60, and down the opposite side 61 to the other end 62 of the floor of the tent.

Each of these structural member 10 is formed with a slight predetermined curvature along its entire length during cooling of each member after extrusion takes place but before each member is cut or notched. In a preferred embodiment, the rate of overall curvature is such that having regard to precalculated inwardly directed forces and the confining and containing effect produced by the sleeves fitted to the tent an inward collapse of the bearing member would be prevented. The increase curvature required to form the corners 100 is of course created by notching the structural member at the sections of the members which are to form the corners 100.

Figure 11:
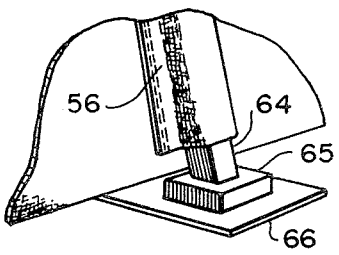
FIG. 11 is a perspective view showing the manner in which one end of each of the structural members of FIG. 8 is secured for erection to the tent.

The sleeve 56 can be formed in the usual manner by sewing a strip of canvas or other suitable material to the outside of the sheet of canvas forming the walls and roof of the tent. Preferably each of the sleeves 56 is lined with a smooth surfaced strong synthetic. The strip is sewed at each of its longitudinal edges to the sheet of canvas. An end 64 of each structural member 10 is inserted in one of the open ends of one of the passageways and the structural member is then fed through the passageway until the initially inserted end 64 of the member 10 projects out of the other end of the passageway. FIG. 11 illustrates the manner in which each end 64 of the structural members is secured. Two cups 65 are attached to extensions 66 of the tent floor 55, each extension being positioned adjacent the open end of one of the passageways along the end 62 of the tent floor. The cups 65 have an open top adapted to receive the ends 64 of the structural members, and may be made of any suitable material such as wood, steel or a tough plastic. Two stakes are driven into the ground at points 66 and are fitted with cups 67 at their top ends. These cups 67 may either be part of the stakes themselves or may be securely attached to the stakes. The cups 67 are also open-topped and are adapted to receive the ends 68 of the structural members. The end 62 of the tent floor may now be staked to the ground with stakes (not shown).

The tent is then erected by inserting the ends 64 of the structural members into the cups 65, inserting the ends 68 into the cups 67, and bending the structural members until they assume the necessary, predetermined shape which in the case of the illustrated tent is a U-shape. The structural members are then in the upright, rigid position shown in FIG. 10. The sleeves 56 are then adjusted so that each sleeve extends over the length of its respective structural member in the manner shown in FIG. 10. Tent pegs 69 are then driven into an extension 70 on each of the longitudinal sides of the tent floor to secure the sides of the tent. If desired, tent pegs may also be used along the end 58 of the tent floor in a manner similar to that in which the pegs 69 are used along the sides. It will be readily understood from FIG. 11 that the floor 55 of the tent, together with the ends of the sleeves 56 at the ends 68, acts as a tension member extending between the end 64 and end 68 of each structural member, ensuring the rigidity of each structural member.

The structural members of the present invention can be constructed quickly and inexpensively by forming the elongate one-piece body member 12 by an extrusion process. During this extrusion process, the flexible reinforcing members 32 are embedded into the one side 30 of the body member so that they extend longitudinally in the body member. After a suitably long piece of the formed flexible material has been extruded, the piece is cut off at the desired length to create the body member 12. The passageways 20, 22, and 24 can also be formed in the flexible material as it is being extruded if these passageways are desired (i.e. for the insertion of the sheer members or to lighten the weight of the structural member when completed).

The overall rate of curvature in the bearing member to be predetermined and imparted during the cooling period after extrusion and the angle of the notch to be made in the bearing member should be so calculated as to make proper allowance for any material lost in the cutting process, and any elongation experienced as a result of formation of hinges at the joints 34 of the structural member.

The formed body member is then cut or notched by any suitable cutting or notching means to form the transverse cuts 14 or V-shaped notches 16 along the length of the body member. This cutting or notching may take place at the same time as the extruded piece is cut-off at the desired length to form the body member. The angle X formed by each V-shaped notch is selected, as mentioned above, to permit the structural member to form a predetermined curved shape when the structural member is uncoiled to form the frame member. Cutting or notching can take place either before or after insertion of the sheer members but it is simpler if cutting or notching takes place first because, if it does not it becomes necessary to cut around the outer periphery of the sheer members in such a manner that the sheer members themselves are not cut. The cuts 14 or notches 16 must not be so deep that they cut the flexible reinforcing members 32 which extend through the flexible joints 34 formed by the cuts or notches.

Preferably, after cutting or notching takes place, a hinge is formed at the bottom of each cut or notch. The method of forming such hinges in polypropylene is known per se and involves bending adjacent segments at a suitable temperature with respect to each other about the joint 34 between them, first in one direction and then in the other direction.

Figure 12:
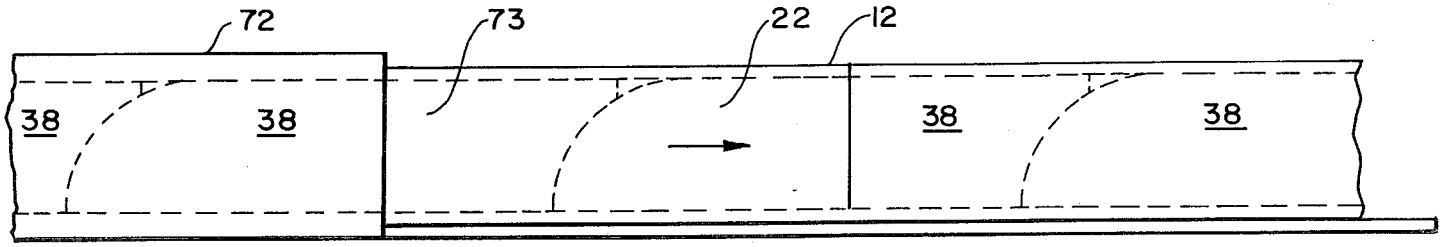
FIG. 12 is a partial side view showing the manner in which the sheer members can be inserted in a passageway in the structural member.

The sheer members 38 are preferably inserted, after being stamped into the desired form, in one end 73 of the centre passageway 22 in the manner shown in FIG. 12. The members 38 may be simply squeeze fitted into the passageway or cooled before insertion and then squeeze fitted. If the members 38 are cooled beforehand, they may be inserted into the passageway by means of an open-ended, refrigerated rectangular tube 72 which is aligned with the open end of the passageway. The members 38 are then fed through this tube in a cooled state in an end-to-end relationship as shown in FIG. 12 in the direction indicated by the arrow. When the front sheer member reaches the end member segment 36 at the end of the body member opposite the end 73 and the sheer members are properly aligned in their respective member segments in the manner shown in FIG. 7, no further sheer members are inserted. The sheer members are then allowed to warm up so that they attain the temperature of the surrounding body member. Since the dimensions of the sheer members when cooled closely correspond to the dimensions of the passageway 22, thermal expansion of the sheer members results in the sheer members forming a tight fit with the surrounding passageway and thus being held securely in their proper position.

If desired, the final sheer member to be inserted in the passageway 22 can be shortened before insertion so that it does not have any portion projecting out of the body member at the end 73 thereof. Alternatively, the sheer member for the member segment at the end 73 could be omitted altogether with the last sheer member 38 being pushed through by suitable means to the second member segment from the end 73.

Preferably the ends of the passageway 22 of the structural member are sealed after insertion of the sheer members, particularly where the sheer members have simply been squeeze fitted into the body member. The ends may be sealed with any suitable sealant, preferably a material compatible with polypropylene if the body member is constructed of this material. The ends of the structural member are sealed so as to prevent displacement of the sheer member closest to each end. The rigidly-held end sheer members thus help to hold the remaining sheer members in place. Since the forces applied against each end of each sheer member are equal so as to balance each other when the structural member is uncoiled to form a frame member, nothing further is required to maintain the sheer members in their proper position.

Figure 13:
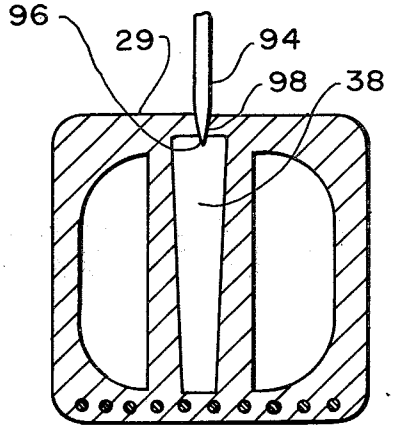
FIG. 13 is a sectional view similar to FIG. 2 showing one method of fixing the sheer member in the centre passageway of the member.

An alternative method of fixing the sheer members in the passageway 22 is shown in FIG. 13 which shows a cross-section of the structural member 10 having a sheer member 38 contained in the centre passageway 22. Each sheer member is simply pushed into the passageway 22 from one end of the structural member and then, when in position, spot welded to the walls of the member 10 which form the passageway 22. In FIG. 13, a spot welding rod 94 with a sharp pointed end is forced through the top side 29 of the structural member until it reaches and contacts the sheer member.

The pointed end of the rod 94 is sufficiently hot to melt the surrounding upper surface 96 of the sheer member and the adjacent portion 98 of the side 29 so that the surface 96 and the portion 98 are fused, thus holding the sheer member 38 firmly in place. This spot welding may be carried out simply at the longitudinal center of each member segment or at several locations along the length of the sheer member, if desired.

Heating the surface 96 with the rod 94 may also result in the surface 96 bulging outwardly along with the portion 98 of the side 29. This bulging action will also prevent the sheer member from moving in the passageway 22.

Figure 9:
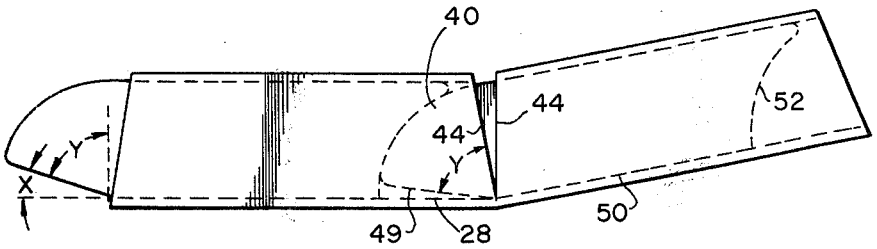
FIG. 9 is a side view of two member segments of a structural member adapted to form a curved frame member and showing the form of the protruding portions of the sheer members.

The end portions 40 of the sheer members must of course be stamped in the form described above, the form of the end portion depending on whether the uncoiled structural member is to be straight or curved and, if the latter, the amount of curvature. Thus the longitudinal profile of each end portion (as seen in FIG. 6 and 9) is varied according to the predetermined shape which the uncoiled structural member is to assume or form.

Thus it is apparent that there has been provided, in accordance with the invention, a structural member and method of construction thereof that fully satisfies the objects, aims and advantages set forth above. While the invention has been described in conjunction with specific embodiments thereof, it is evident that many alternatives, modifications, and variations will be apparent to those skilled in the art in the light of the foregoing description. Accordingly, it is intended to embrace all such alternatives, modifications and variations as fall within the spirit and broad scope of the appended claims.

What I claim as my invention is:

1. A method of constructing a structural member capable of being coiled by bending said member in one direction and being uncoiled by bending said member in the opposite direction to form a frame member, said method comprising forming an elongated one-piece body member of suitably flexible material by extrusion of said material, embedding suitably high strength, flexible members in one side of said body member during said extrusion, said flexible members extending longitudinally in said body member, and cutting said body member transversely at a number of locations along the length thereof, each cut formed thereby extending inwardly from the side of the body member opposite said one side and having a bottom near but spaced apart from said one side of the body member, whereby a relatively thin, flexible joint at said one side is formed by each cut and has said flexible members extending therethrough.

2. A method of constructing a structural member according to claim 1 including forming a passageway extending lengthwise through said body member during extrusion thereof, inserting sheer members of suitably strong material in said passageway, arranging said sheer members in said passageway whereby each sheer member traverses a respective cut formed by said cutting of said body member when said structural member is uncoiled and absorbs sheer forces in said structural member at its respective cut, and securing said sheer members to prevent longitudinal movement of said sheer members in said passageway.

3. A method of constructing a structural member according to claim 1 wherein each of said flexible members extends substantially the entire length of said body member.

4. A method of constructing a structural member according to claim 2 wherein said sheer members are suitably cooled before insertion in said passageway, are pushed into said passageway from one end thereof in an end-to-end relationship, and are secured in said passageway by means of thermal expansion of said sheer members when said sheer members attain the temperature of said body member.

5. A method of constructing a structural member according to claim 2 including sealing both ends of said passageway after insertion of said sheer members.

6. A method of constructing a structural member according to claim 1, in which said flexible material comprises polypropylene.

7. A method of constructing a structural member capable of being coiled by bending said member in one direction and being uncoiled by bending said member in the opposite direction to form a frame member, said method comprising forming an elongated one-piece body member of suitably flexible material by extrusion of said material, embedding suitably high strength, flexible members in one side of said body member during said extrusion, said flexible members extending longitudinally in said body member, and notching said body member transversely at a number of locations distributed along the length thereof, each notch formed thereby being V-shaped, extending inwardly from the side of the body member opposite said one side, and having a bottom near but spaced apart from said one side of the body member and a predetermined angle formed by the sides of the notch, whereby said body member is divided into member segments by said notches with each member segment being joined to an adjacent member segment by a relatively thin, flexible joint, and wherein the size of said angle is selected to permit said structural member to form a predetermined curved shape when said structural member is uncoiled to form said frame member.

8. A method of constructing a structural member according to claim 2 including forming two further passageways extending lengthwise through said body member, said passageway containing said sheer members comprising a centre passageway, one of said further passageways being on each side of said centre passageway.

9. A method of constructing a structural member according to claim 7 including forming a passageway extending lengthwise through said body member during extrusion thereof, inserting sheer members of suitably strong material in said passageway, arranging said sheer members in said passageway whereby each sheer member traverses a respective notch formed by said notching of said body member when said structural member is uncoiled and absorbs sheer forces in said structural member at its respective notch which is closed, and securing said sheer members to prevent longitudinal movement of said sheer members in said passageway.

10. A method of constructing a structural member according to claim 2 including forming said sheer members by extruding said sheer members from a body of said suitably strong material and then cutting said members to a suitable longitudinal profile, one end of each sheer member being so shaped with respect to its longitudinal profile as to permit said structural member to form a predetermined shape when said structural member is uncoiled to form said frame member.

11. A method of constructing a structural member according to claim 10 wherein suitably high strength, flexible members are embedded in said opposite side, said flexible members extending longitudinally in said body member through each flexible joint.

12. A method of constructing a structural member according to claim 11 wherein said body member has a passageway extending lengthwise through said body member, said method including inserting sheer members of suitably strong material in said passageway, arranging said sheer members in said passageway whereby each sheer member traverses a respective cut formed by said cutting of said body member when said structural member is uncoiled and absorbs sheer forces in said structural member at its respective cut, and securing said sheer members to prevent longitudinal movement of said sheer members in said passageway.

* * * * *